US011428492B1

(12) United States Patent
Ding et al.

(10) Patent No.: US 11,428,492 B1
(45) Date of Patent: Aug. 30, 2022

(54) FIREARM SUPPORT BASE AND RELATED METHOD OF USE

(71) Applicant: Leapers, Inc., Livonia, MI (US)

(72) Inventors: Tai-lai Ding, Northville, MI (US); Tat Shing Yu, Plymouth, MI (US); Shih Hao Ku, Westland, MI (US)

(73) Assignee: Leapers, Inc., Livonia, MI (US)

( * ) Notice: Subject to any disclaimer, the term of this patent is extended or adjusted under 35 U.S.C. 154(b) by 50 days.

(21) Appl. No.: 17/196,490

(22) Filed: Mar. 9, 2021

(51) Int. Cl.
*F41A 23/10* (2006.01)

(52) U.S. Cl.
CPC ..... *F41A 23/10* (2013.01)

(58) Field of Classification Search
CPC ..... F41A 23/10
See application file for complete search history.

(56) References Cited

U.S. PATENT DOCUMENTS 271,251 A * 1/1883 Leerbech et al. ..... F41A 23/16 89/40.06
575,529 A * 1/1897 Stephens ..... B62H 1/06 248/171
2,206,373 A * 7/1940 Stieber ..... F16B 7/025 403/368
2,261,505 A * 11/1941 Schlesinger ..... F16B 12/40 285/298
2,262,112 A * 11/1941 Nash ..... F16D 15/00 403/370
2,461,915 A * 2/1949 Neuwirth ..... F16M 11/32 248/188.5
2,844,905 A * 7/1958 Walton ..... F41A 23/06 248/354.3
2,992,026 A * 7/1961 Farber ..... F16B 7/10 248/188.5
3,318,170 A * 5/1967 Runkle ..... B62D 1/185 464/169
3,445,082 A * 5/1969 Frazer ..... F41A 23/08 248/183.3
4,215,839 A * 8/1980 Gibran ..... F16M 11/16 248/170
4,351,224 A * 9/1982 Curtis ..... F41A 23/08 89/37.04
4,625,620 A * 12/1986 Harris ..... F41A 23/08 89/37.04
4,844,390 A * 7/1989 Duke ..... F41C 33/001 224/232
5,029,407 A * 7/1991 Kirkpatrick ..... F41A 23/10 42/94

(Continued)

*Primary Examiner* — Michelle Clement
(74) *Attorney, Agent, or Firm* — Warner Norcross + Judd LLP

(57) ABSTRACT

A base detachably joined with a support pod, which supports a weapon in a firing position, is provided with finely tuned length adjustability. The base can include a quick detach first connector joined with a lower end of a leg of a support pod, a threaded core post having a shaft, and an actuator sleeve threadably and rotatably engaged with the core post to extend and/or retract the core post, and thereby adjust a length of the base. The base can include a locking ring rotatable to move along the threaded portion, the locking ring configured to selectively engage the actuator sleeve and prevent the actuator sleeve from rotating, to thereby set the length of the base at a fixed length. A related method of use is provided.

20 Claims, 5 Drawing Sheets

(56) References Cited

U.S. PATENT DOCUMENTS 5,074,188 A * 12/1991 Harris ..... F41A 23/08 89/37.04
5,081,782 A * 1/1992 Wright ..... F41A 23/16 42/94
5,222,705 A * 6/1993 Gibran ..... F16M 11/04 403/328
5,345,706 A * 9/1994 Brown ..... F41A 23/06 42/94
5,438,786 A * 8/1995 Hilderbrand ..... F41A 23/14 248/171
5,593,239 A * 1/1997 Sallee ..... E04H 12/182 403/377
5,711,103 A * 1/1998 Keng ..... F41A 23/08 89/37.04
5,924,658 A * 7/1999 Shiery ..... F16B 7/1409 248/161
5,937,560 A * 8/1999 Beltz ..... F41A 23/06 42/94
6,289,622 B1 * 9/2001 Desch, Jr. ..... F41A 23/10 42/94
6,305,116 B1 * 10/2001 Parker ..... F41A 23/04 89/37.04
6,539,660 B1 * 4/2003 Yeargin ..... F41A 23/10 89/37.04
6,763,627 B1 * 7/2004 Kaempe ..... F41A 23/10 89/37.04
7,614,174 B1 * 11/2009 Beltz ..... F41A 23/10 42/72
7,676,977 B1 * 3/2010 Cahill ..... F16M 11/16 248/168
7,793,454 B1 * 9/2010 Beltz ..... F41A 23/10 42/72
8,291,633 B1 * 10/2012 Hass ..... F41A 23/10 89/37.03
8,418,394 B2 * 4/2013 Keng ..... F41A 23/10 248/163.2
9,303,940 B2 * 4/2016 Bonelli ..... F16M 11/14
10,012,465 B1 7/2018 Liechty
10,254,069 B2 * 4/2019 Palu ..... F41A 23/10
10,295,292 B2 * 5/2019 Ding ..... F41A 23/06
10,323,897 B1 * 6/2019 Ding ..... F41A 23/06
10,408,555 B2 * 9/2019 Flood, Jr. ..... F41A 23/10
2005/0188588 A1 * 9/2005 Keng ..... F41A 23/10 42/72
2005/0188597 A1 * 9/2005 Keng ..... F41A 23/08 42/94
2005/0207749 A1 * 9/2005 Barker ..... F16M 11/28 396/428
2005/0242250 A1 * 11/2005 Keng ..... F16M 11/26 248/512
2008/0052979 A1 * 3/2008 Lee ..... F41A 23/08 42/73
2012/0272557 A1 * 11/2012 Yan ..... F41C 23/12 42/72
2014/0115940 A1 * 5/2014 Bonelli ..... F41A 23/10 42/94
2014/0259849 A1 * 9/2014 Jakele ..... F41C 23/22 42/74
2016/0265864 A1 * 9/2016 Poling ..... F41A 23/10
2017/0205180 A1 * 7/2017 Ding ..... F16G 11/10
2018/0202746 A1 * 7/2018 Flood, Jr. ..... F41A 23/10
2018/0259287 A1 * 9/2018 Palu ..... F41A 23/10
2019/0072355 A1 * 3/2019 Pop ..... F41A 23/10
2019/0293378 A1 * 9/2019 Flood, Jr. ..... F41A 23/10

* cited by examiner

FIREARM SUPPORT BASE AND RELATED METHOD OF USE

BACKGROUND OF THE INVENTION

The present invention relates to weapons, and more particularly to a weapon accessory that can support a weapon in a firing or other position.

When firing a weapon at a target, it is usually helpful to have the weapon stabilized and unmoving to ensure proper target acquisition, aiming and shot placement. There is a variety of supports available to fulfill this function. A popular support for small arms is the bipod. A bipod typically attaches to the front handguard or stock of a firearm or other small arm, and projects downwardly therefrom. A bipod usually includes two spring-loaded legs that deploy from a transport position to a deployed position, in which they are ready to support the firearm during fire.

Many bipods are adjustable in height to enable a user to raise or lower the barrel of the rifle and precisely aim or fire it at a target, particularly one at a long distance. Most conventional bipods also include feet or bases that engage the ground. The bipod feet are mounted to the bottoms of the respective legs of the bipod, and can be contoured or textured to engage different ground surfaces. For example, some bipod feet include a soft rubber bottom so that the feet can be placed on surfaces without marring or scratching the same. Other bipod feet include spikes to dig into and provide firm contact with the ground.

While most bipod feet provide enhanced engagement of the bipod legs with a support surface, they have several shortcomings. For example, conventional bipod feet typically have a fixed profile. Accordingly, where a bipod leg, to which the foot is attached, only has fixed length adjustments, the user is left without many options to fine-tune the level and alignment of the weapon to which the bipod is attached. Further, where the bipod feet are removable from the bipod legs, a user may resort to switching out various sized and shaped bipod feet to accommodate different shooting positions and terrain on which the bipod is rested.

Accordingly, there remains room for improvement in the field of support pods to support weapons in a firing position.

SUMMARY OF THE INVENTION

A base detachably joined with a support pod, which supports a weapon in a firing position, is provided with finely tuned length adjustability. The base can include a quick detach first connector joined with a lower end of a leg of a support pod, a threaded core post having a shaft, and an actuator sleeve rotatably engaged with the core post to extend and/or retract the core post, and thereby adjust a length of the base.

In one embodiment, the base can include an integral footpad that is permanently secured to the base, or a detachable, replaceable footpad that can be replaced, optionally manually, without the use of tools, relative to the base, so a user can customize the engagement of the base with a support surface, such as the ground or some other surface over which the weapon is placed.

In another embodiment, the base can include a locking ring rotatable to move along the threaded portion. The locking ring can selectively engage the actuator sleeve and prevent the actuator sleeve from rotating, to thereby set the length of the base at a fixed length.

In still another embodiment, rotational movement of the actuator sleeve translates to linear movement of the core post to adjust the length of the base. After the length is adequately adjusted, the locking ring can be threaded to abut the actuator sleeve so that the adjustment sleeve is held in a fixed positon relative to the core post.

In yet another embodiment, the shaft of the core post defines a slot and a pin projects through the shaft to prevent relative rotational movement of the core post relative to the first connector. Even with this arresting of rotational movement of the core post relative to the first connector, however, the core post can remain linearly moveable toward and away from the first end.

In even another embodiment, the pin can be secured to the first connector or a collar to fix the pin relative to the same. The pin thus also connects the shaft movably to the first connector or collar. The actuator, however, remains rotatable relative to the first connector, but does not move linearly away from or toward the collar.

In another, further embodiment, the core post can include a limiting flange and the locking ring can be threaded. The locking ring can be moveable along the threaded portion of the core post between the actuator sleeve and the limiting flange. When the locking ring engages the limiting flange, it stops, so the limiting ring does not thread off the base.

In a further embodiment, the locking ring is moveably disposed between the actuator sleeve and the footpad. The actuator sleeve and the locking sleeve can be rotatable, however, the footpad is not rotatable relative to the remainder of the base.

In yet a further embodiment, the support pod can be a leg of a monopod, bipod, tripod or other legged weapon support. The base can be detachably mounted to a lowermost extremity of the leg. The leg itself can be adjustable in length, with its own mechanisms located above the lowermost extremity. The base, however, also can be length adjustable, in which case the leg is independently length adjustable, and the base also is independently length adjustable. Optionally, the base can provide finer length adjustment than the leg length adjustment.

In even a further embodiment, a method of using a base to orient a weapon in a firing configuration is provided. The method can include releasably engaging, with the first connector, a support pod lower end distal from a pod connector of the support pod that engages a weapon, the first connector being actuatable to release the first connector from the support pod lower end upon actuation by a user, the first connector being joined with a core post having a threaded portion and a shaft extending from the threaded portion; rotating the actuator sleeve relative to the core post to at least one of extend and retract the core post along a longitudinal axis, and thereby adjust a length of the base; and moving a locking ring along the core post to selectively engage the actuator sleeve and prevent the actuator sleeve from rotating, to thereby set the length of the base at a fixed length.

In still another embodiment, the method can include providing a second connector joined with the core post; and releasably engaging a foot with the second connector. The base can be disposed between the end of the support pod and the foot. The second connector can be actuatable to release the foot from the second end.

In yet another embodiment, the method can include defining a slot in the shaft; sliding the slot relative to a pin, the pin fixedly joined with the first connector; and rotating the actuator sleeve relative to the core post so that the actuator sleeve moves the core post and the slot relative to the pin In even another embodiment, the method can include translating rotational movement of the actuator sleeve to linear movement of the core post to adjust the length of the base. Optionally rotational movement of the actuator sleeve can be prevented by engaging the locking ring with the actuator sleeve.

The current embodiments of the base for a support pod and method of use provide benefits related to weapon supports that previously have been unachievable. For example, with the present support pod, a user can quickly and precisely provide quick fine adjustments to the length of a support pod with one hand. Accordingly, the user can still use their other hand to maintain the weapon in a ready position and/or check alignment of their sights with a target while adjusting the barrel of the weapon with the support pod via their other hand. This can increase firing readiness, aiming and shot placement times. The base of the current embodiments can quickly and easily replace traditional quick detach, fixed length footpads for support pods. This can be helpful where the support pod only provides several limited preset leg lengths for height adjustment of that support pod. The adjustable base thus can provide additional, almost infinite adjustability to modify, align and balance the support pod, which can be a bipod, a monopod, a tripod or any pod having any number of legs. Where the locking ring is included, the base can be secured at a set or fixed length to ensure the height adjustment is maintained in the set position under heavy recoil. Where the second connector is included, the base enables a user to mount their favorite footpads for a customized setting. Where the actuator sleeve is rotatably, a user can adjust and control the leg length adjustment via rotating the actuator sleeve without changing the aiming position. Further, the actuator sleeve is configured for rotation to make the length adjustment, however, the core post extends and retracts, without rotating the footpad. Therefore, the user does not have to lift the support pod or footpad off the ground to make an adjustment to the length of the base and thus the support pod to which the base is attached.

These and other objects, advantages, and features of the invention will be more fully understood and appreciated by reference to the description of the current embodiments and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
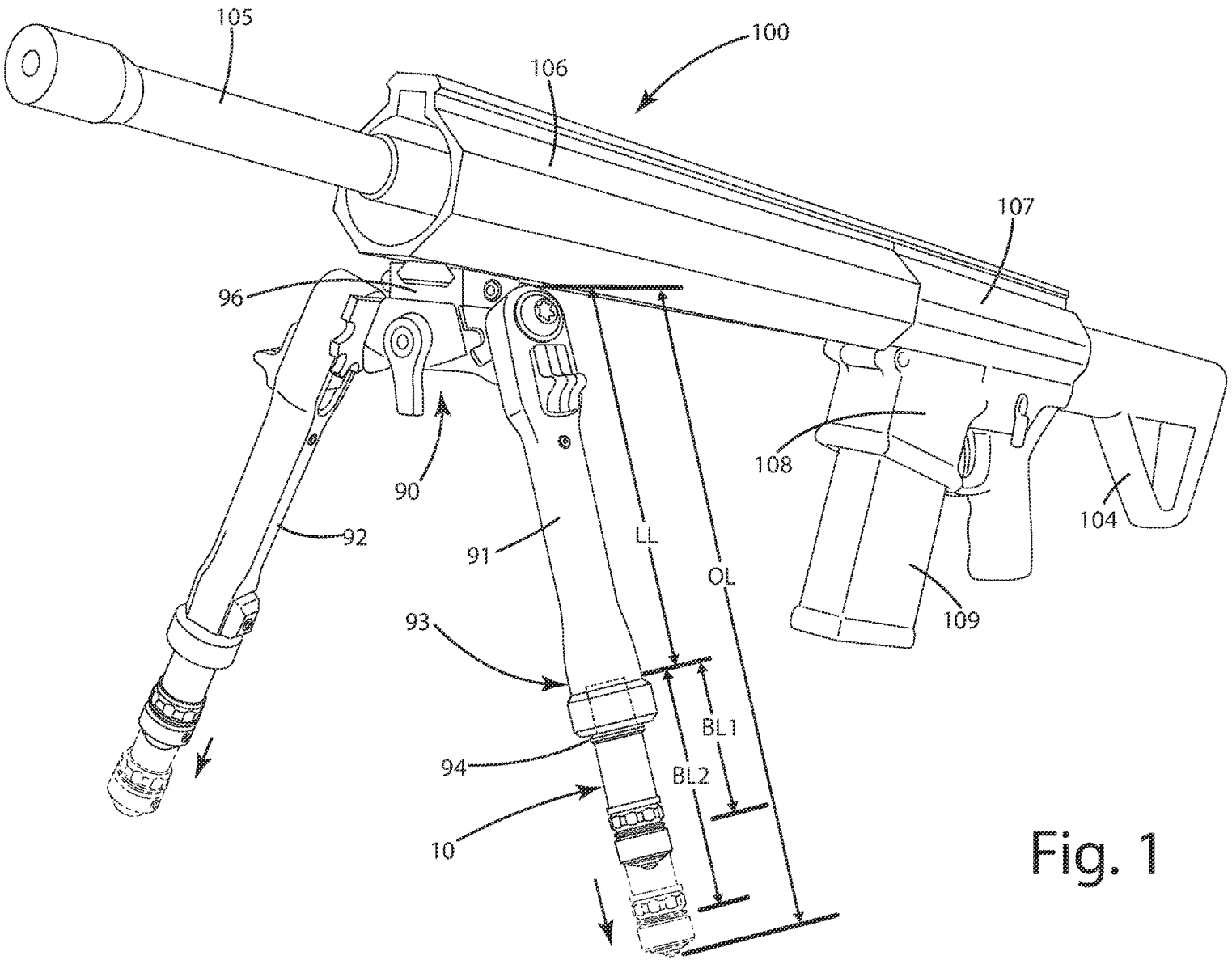
FIG. 1 is a perspective view of the base of a current embodiment attached to a leg of a bipod mounted on a firearm.

A current embodiment of a base for a support pod for a weapon is illustrated in FIGS. 1-5 and generally designated 10. The base 10 is configured to be mounted to a support pod 90, and in particular a leg 91, 92 of the support pod 90, which is mounted to a weapon that is fired at a target. The support pod 90 can be configured to engage a surface of a weapon, for example a handguard of a weapon 100. The weapon 100 illustrated is in the form of a small arm, such as an AR-15 firearm, but of course can be any other type of weapon, including but limited to small arms, such as rifles, pistols, handguns, shotguns, of any firing capability, automatic or semiautomatic or single shot; archery bows, such as cross bows; paint markers, also known as paint ball guns, airsoft guns, BB guns, pellet guns and any other weapon capable of firing a projectile at a target. As shown, the exemplary firearm 100 can include a stock 104 configured to shoulder against a user, a barrel 105, a handguard 106, an upper receiver 107 and a lower receiver 108, which is configured to receive a removable magazine 109.

The support pod 90 as shown can be in the form of a bipod, having two support pods 91, 92 extending downward from the firearm to support it. However, the support pod can be implemented in other pod configurations, such as monopods, tripods, quad-pods or any multi-leg pod configuration depending on the weapon application. In the current embodiment, only one support pod of the bipod will be described in connection with the base 10.

Figure 2:
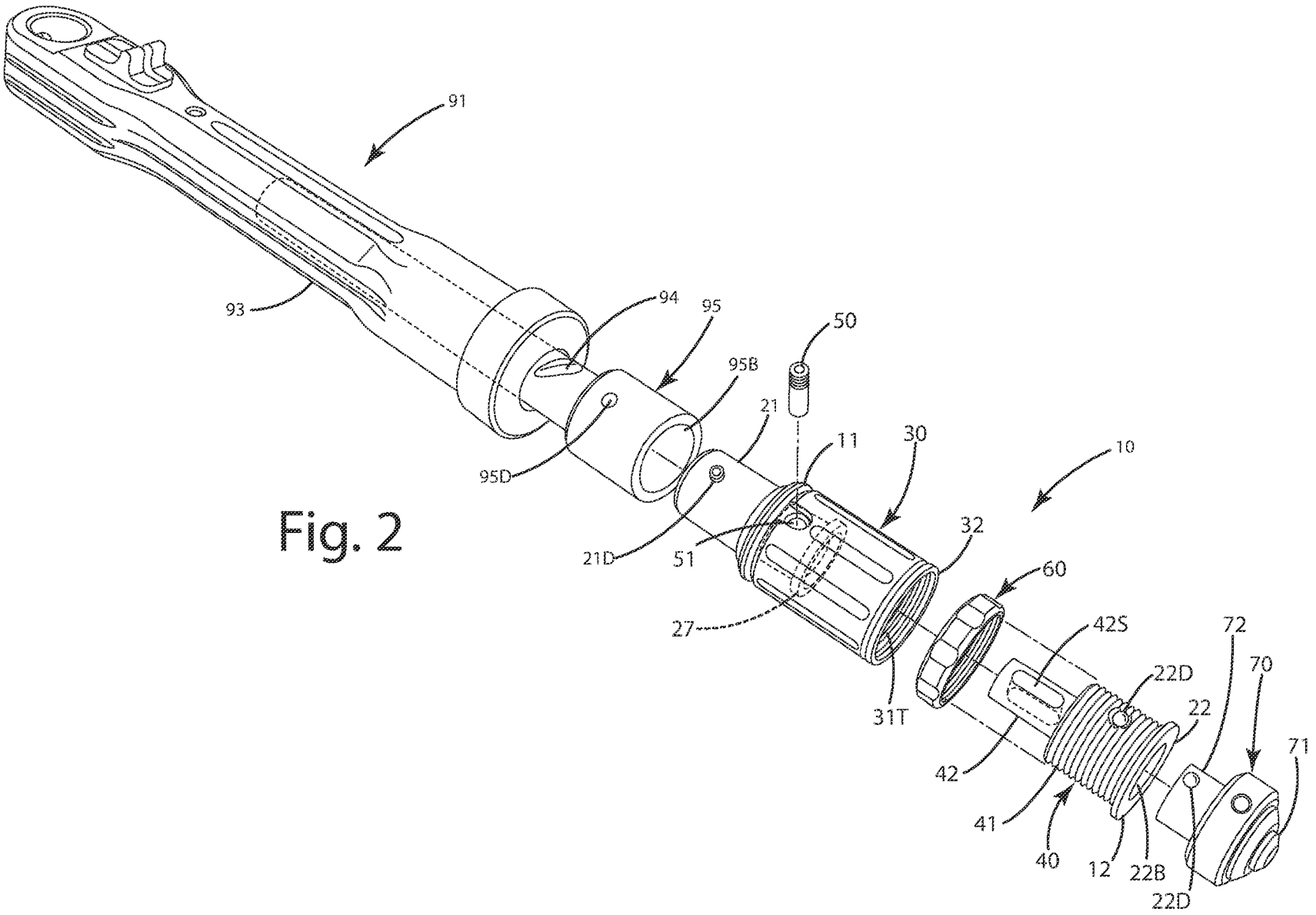
FIG. 2 is an exploded view of the bipod leg, the base and a footpad.

With reference to FIGS. 1-2, the pod 90, and in particular a support pod 91, can include a support tube 93 and a leg 94 that are telescopingly joined with one another. The support tube 93 can extend outwardly and downwardly from the pod connector 96 that engages weapon 100. The interior of the support tube can form a cavity or compartment within the support tube. The leg 94 can be telescopingly disposed in the support tube. The support pod 91 can extend and retract, based on the telescoping of the leg relative to the support tube. The movement of these two elements relative to one another can adjust the length LL of the support pod.

The base 10 as noted above can be secured to the support pod 91, and optionally to the leg 94 at its lower end 95 as described below. The base can include a base length that itself can be modified or altered from a first base length BL1 to a second greater base length BL2 and vice versa. This base length alteration or modification can be independent and separate from any alteration or modification of the length LL of the support pod. Put another way, a user can change the length LL of the support pod, without changing the length of the base. When this occurs however, the overall length OL of the entire support pod plus the base will change, even though the length of the base does not change. A user also can change the can change the length of the base, without changing the length LL of the support pod. When this occurs however, the overall length OL of the entire support pod plus the base will change, even though the length LL of the support pod does not change. Of course, a user also can change the length of the base and the length LL of the support pod nearly at the same time, in different operations and with a different manipulation of mechanisms, to alter the overall length OL.

As shown in FIG. 2, the support pod 91 can include a lower end 95 that is distal from the pod connector 96. That lower end optionally can be part of the leg 94. The lower end can be the lowermost extremity of the support pod 91, and can be the end of the leg 94. The lower end 95 can define a bore 95 be that extends upwardly into a portion of the leg 94. A detent 95D, which optionally can be a ball detent receptacle, can be included in the lower end 95. This receptacle 95D can interface with a corresponding detent 21D of a first connector 21 on the first end 11 associated with the base 10. The corresponding detent 21D can be in the form of a ball detent that is urged to an extended position with a spring (not shown). The first connector 21 can be inserted into the bore 95B and can closely fit in that bore with tight tolerances to avoid excess wiggle and movement of the base 10 relative to the leg 94 the support pod 91. The first connector detent 21D can interlock with the detent 95D to secure the base 10 to the support pod 91. Although shown as a detent, any other coupling mechanism that provides a quick detachment or removal of the base 10 from the support pod 91 can be used. Other coupling mechanisms can include cams, threaded portions, catches, locks, latches and the like. The base 10 can be detachable from the support pod 10 manually by a user, without the use of tools. In some applications, however, a special or common tool can be used to remove the base 10 from the support pod 91.

Figure 3:
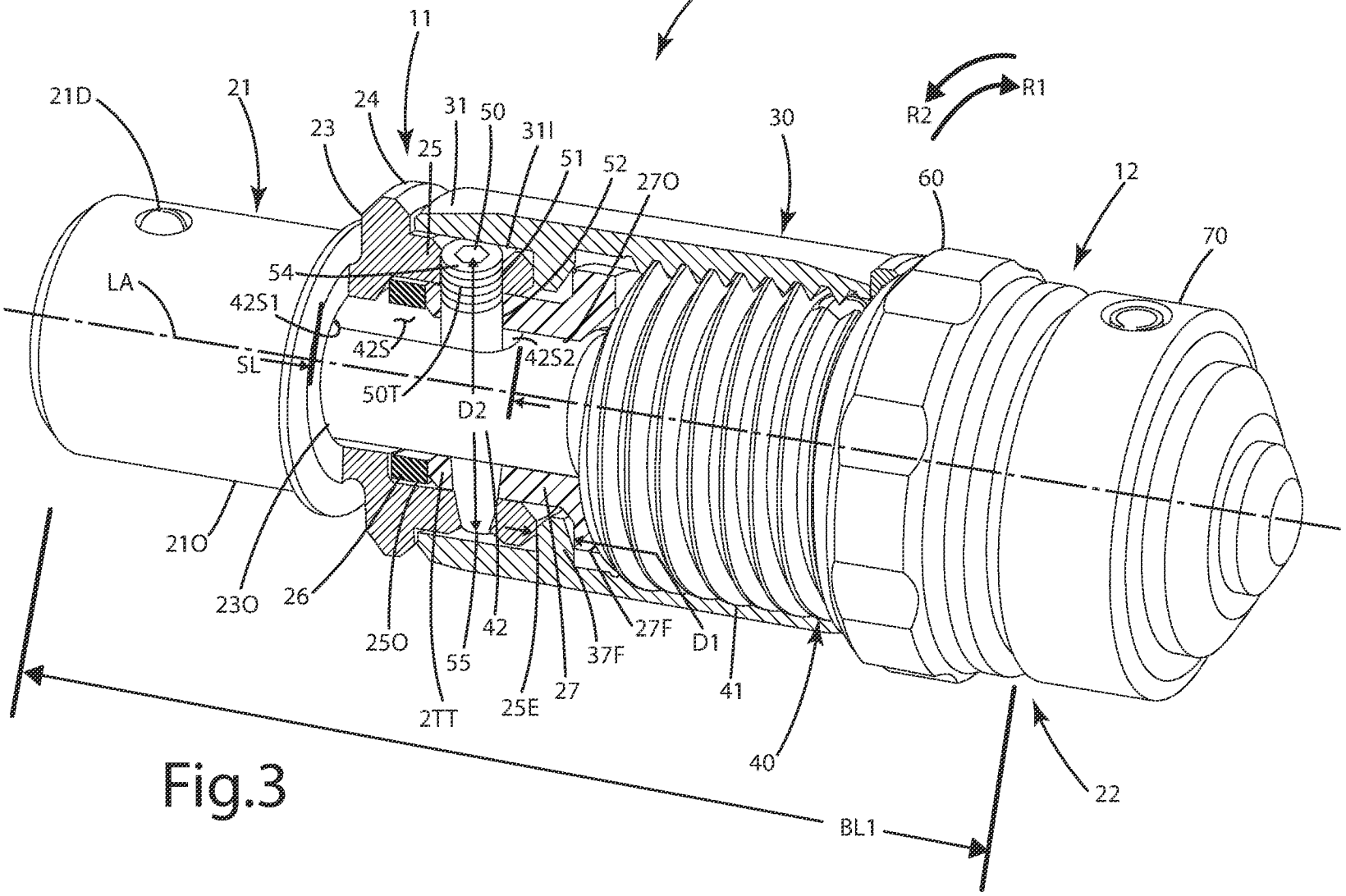
FIG. 3 is a partial section view of the base in a retracted mode.

With reference to FIG. 3, the first connector 21 of the support pod 10 can be disposed on the first end 11 of the base 10, which is opposite from a second end 12 of the base. The first connector 21 can be or can include a collar 23. The collar 23 can include a limiter ring 24 that extends outwardly, away from the longitudinal axis LA. The limiter ring 24 also can extend annually and outwardly around an outer surface 210 of the first connector 21. As described below, the limiter ring 24 can be disposed adjacent the actuator sleeve 30 so the actuator sleeve cannot ride up the first connector or the collar in general. The limiter ring 24 can be bounded by a shoulder 25, which can be at least partially disposed inside the actuator sleeve 30. This shoulder 25 can abut an upper or first end or rim 31 of the actuator sleeve 30. That upper end or rim 31 can slide and move relative to the shoulder 25 and the limiter ring 24, where included, when the actuator sleeve 30 rotates about the longitudinal axis LA.

The first end 11, first connector and/or the collar 23 can define an internal bore 20 30 that can extend along the longitudinal axis inward from the outer surface 210. This internal bore 230 can be configured and sized to closely receive a shaft 42 of a core post 40 which also includes a threaded portion 41 as described below. The first connector 21 can include a secondary bore 250 which is defined inside the shoulder 25. This secondary bore 250 can house an annular washer 26 and a bushing 27. The washer 26 can be disposed between a portion of the first connector and the bushing 27 so as to provide a tight fit between the bushing and the first connector. Optionally the washer 26 can be an elastomer, such as rubber or silicone, or metal, such as steel or brass, or some other materials depending on the application.

The bushing 27 can be fixedly joined with the first end 11 and generally to the first connector 21 and collar 23. The bushing 27 can include a first flange 27F. This first flange 27F can be spaced a distance D1 from an end 25E of the shoulder associated with the collar 23 and first end 11. The bushing 27 can include a tubular portion 2070 that extends from the first flange 27F, upward inside the secondary bore opening 250 of the first connector 21 or the first end 11. This tubular portion 27T can include a bore 270 that extends away from the flange 27F an upwardly toward the washer 26. In some cases, the internal diameter of the washer 26 and this bore 270 as well as the bore 230 can be the same diameter.

As shown in FIG. 3, the core post 40 can include the shaft 42. The shaft 42 can include an elongated slot 42S that is closed at opposing ends 42S1 and 42S2. The slot 42S can extend through the shaft from one side surface to the other, for example, across a diameter of the shaft where the shaft is cylindrical. Of course, the shaft can be polygonal, elliptical of other cross sectional shapes. The length of the slot SL can control the total amount of length adjustment of the base. The base 10 can include a pin 50 that extends through and can be trapped within the slot 42S. The pin 50 also can extend through corresponding hole 51 defined in the first connector and/or the shoulder 25 as well as a hole 52 defined in the bushing 27. The pin can pass completely through the shoulder and the bushing and can be friction fit therein. In some cases, the holes 51, 52 can be threaded to interface with corresponding threads 50T of the pin 50. In this construction, the pin 50 can be screwed into and secured in the respective holes 51, 52.

As illustrated in FIG. 3, the ends 54 and 55 of the pin 50 can be disposed inwardly from the interior 311 of the actuator sleeve 30. This interior 311 can include an inner dimension or diameter D2 of that actuator sleeve 30. In some cases optionally, the length of the pin can be less than the inner diameter D2 of the actuator sleeve 30. The pin itself can extend through the hole defined by the collar and through the slot defined by the shaft 42. The pin can be registered in and slidable relative to the slot 42S. The pin can be fixedly joined with the first end 11, for example the shoulder 25, the collar 23 and the first connector 21. The core post 40 can be movably and slidably joined with the first end 21 and first connector. The core post can move linearly relative to the longitudinal axis LA to extend and retract relative to the first connector 21 and/or the first end 11, however, the core post cannot be disassociated from the first end during the extension or retraction. The pin 50 also projects through the shaft to prevent disassociation, and relative rotational movement of the core post relative to the first end 21, the collar 23, and the bushing 27. Even with the connection via the shaft capturing the pin in the slot 42S, however, the core post can remain linearly movable toward and away from the first end upon actuation of the actuator sleeve 30.

Figure 4:
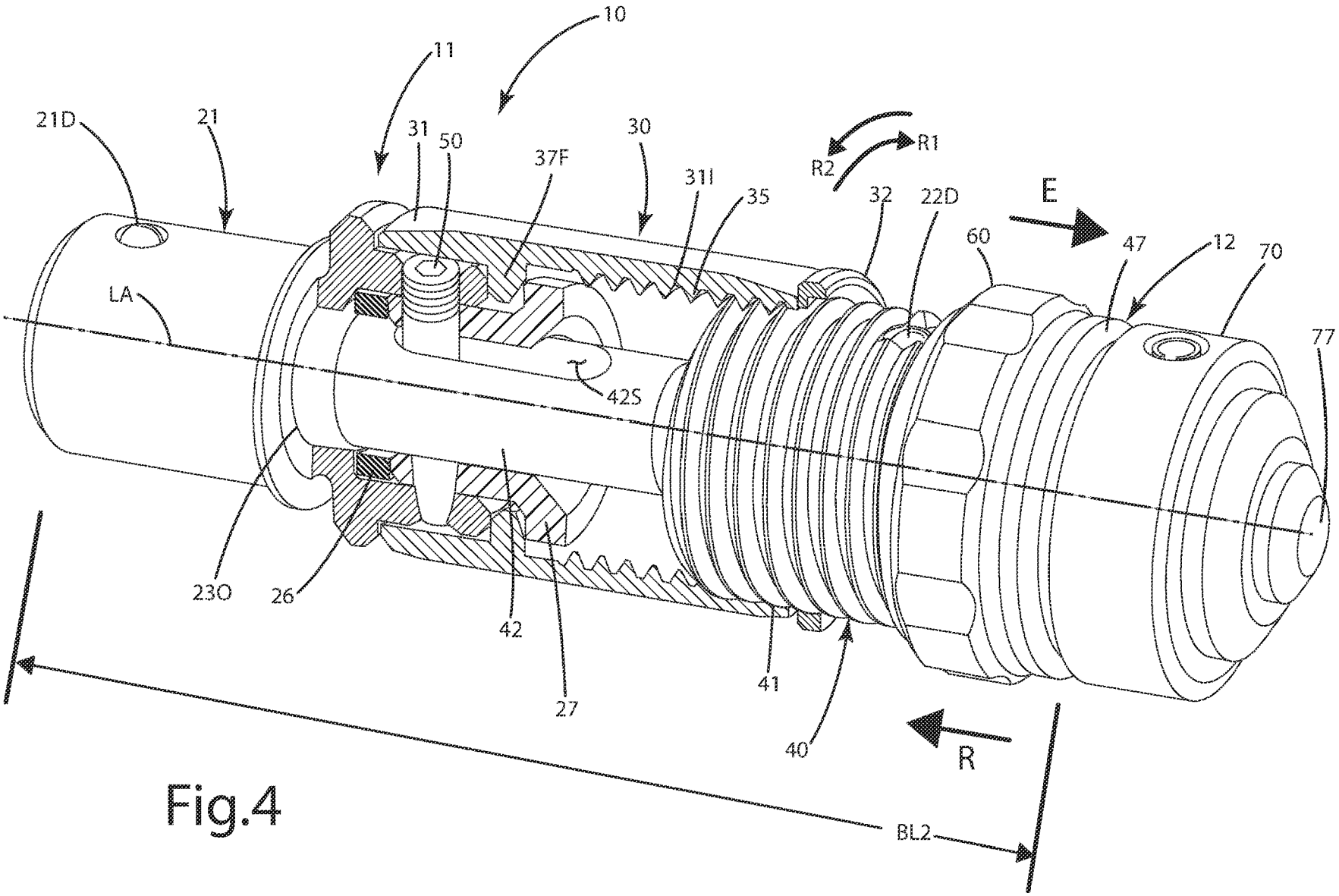
FIG. 4 is a partial section view of the base in an extended, unlocked mode.

As shown in FIG. 4, the actuator sleeve 30 includes an upper rim 31. Distal from the upper rim 31 is the lower rim 32. The actuator sleeve can include an internal threaded portion 35 which can begin below or under the actuator sleeve flange 37F. The interior 311 of the actuator sleeve can be threaded starting below the flange 37F and extending to the second end or lower rim 32. Again, as mentioned above, the actuator sleeve can be rotated in direction R1 and/or R2, which generally can be clockwise and counterclockwise about the longitudinal axis LA of the base 10. The inner threads 35 can engage the threaded portion 41 of the core post 40. Thus, when the actuator shaft 30 is rotated, the internal threaded portion 35 engages the threaded portion 41. In so doing, the interface of the threads will cause the core post 40 to extend away from the first and 11 in direction E as shown in FIG. 4. In turn, the base length can increase from BL1 shown in FIG. 3 to BL2 shown in FIG. 4. The base length BL2 is greater than the base length BL1 due to the core post extending outward and away from the first end 11 as well as the first connector 21 and the actuator sleeve 30.

The second end 32 of the actuator sleeve can include an engagement surface that engages the locking ring 60. When the locking ring 60 engages the lower end or lower rim 32, the locking ring can prevent rotation of the actuator sleeve 30 about the longitudinal axis LA. For example, as shown in FIG. 3, the locking ring 60 is abutted against and frictionally engaging the lower end or lower rim 32 of the actuator sleeve. With the locking ring in this position, the actuator sleeve 30 is not adjustable, and the base is set at a fixed length. Accordingly, the length of the base cannot be adjusted with the actuator sleeve. This can be helpful where the base undergoes vibration due to recoil of the weapon when it is shot.

As shown, the locking ring 60 can be moved toward and away from the first end 11 along the threaded portion 41 of the core post 40 rotating in directions R1 or R2. The core post 40 also can include another limiter ring 47. This limiter ring 47 can ensure that the locking ring 60 does not thread off the core post. Generally, the locking ring can be movably and rotatably disposed between the actuator sleeve 30 and the limiter ring 47 at the second end 12 of the base 10.

Figure 5:
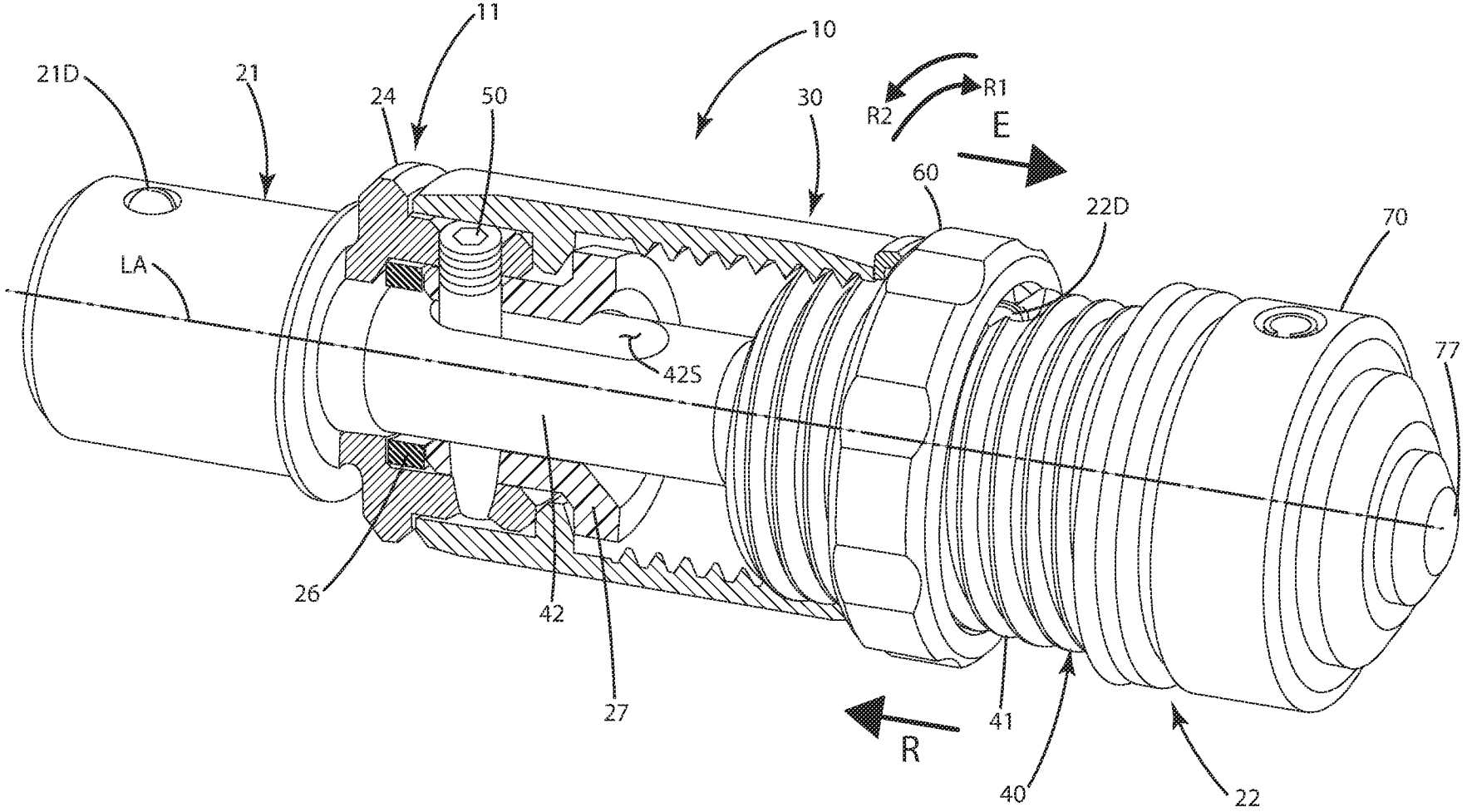
FIG. 5 is partial section view of the base in an extended, locked mode.

As shown in FIGS. 4-5, the locking ring 60 can be threaded on the threaded portion 41 of the core post 40. The locking ring is rotatable directions R1 or R2 to move along threaded portion generally toward and away from the actuator sleeve. The locking ring thus can be configured to selectively engage the actuator sleeve 30 prevent the actuator sleeve from rotating. As a result, the core post 40 can no longer extend and retract in directions E or R as shown in FIG. 5. As a result, the locking ring can set the length of the base at a fixed length. Of course, the locking ring can be removed in some applications when the actuator sleeve suitably engages the core post to set a length of the base 10.

The base 10 as mentioned above can include a first connector 21 that connects the base 10 to the support pod 91. The base also can include a second connector 22 at the second end 12 of the base distal from the first end 11. This second connector 22 can include a bore 22B that is defined inside the core post 40 extending toward the shaft 42. This second connector 22 can be sized and configured to receive a footpad 70. In particular, the footpad 70 can include a ground engaging portion 71 and a connecting element 72 extending upwardly from ground engaging portion 71. The ground engaging portion 71 can be in the form of a pointed element and optionally can include one or more projections to engage the ground surface. Alternatively, the ground engaging element 71 can include a rubber foot that can be placed on surfaces without marring or damaging them substantially. The connecting element 72 can be sized and configured to fit inside the bore 22B.

The second connector 22 can include a detent 22D. This detent 22D can include a hole defined by the core post optionally in the threaded portion 41. The connection element 72 can include a spring-loaded ball detent 22D that can engage in fit within the hole defined by the threaded portion of the core post to detachably secure the footpad 70 to the second connector 22 and second end 12 of the base. Optionally, the second connector 22 is configured to releasably engage the footpad 70. The second connector 22 can be actuatable to release the footpad 70 from the second end 12 of the base upon actuation by user. For example, the user can pull on the footpad to disengage the detent from the core post. As a result, the connection element 72 can be slid out from the bore 22B. With the footpad 70 being easily removable from the base 10, that footpad can be replaced with another footpad suitable for a ground surface upon which the base and support pod are used. Alternatively, the footpad 70 can be modified or repaired and then replaced and joined with the base 10. Although shown as a removable, replaceable footpad 70, that footpad 70 alternatively can be integrally secured to the core post 40 in some applications.

As mentioned above, the bushing flange 27F can be spaced from the end 25B of the shoulder or collar. The actuator sleeve 30 can include in inwardly extending flange 37F that fits within this distance or the gap between the bushing flange 27F and the end 25B of the collar or shoulder. The flange 37F can be trapped in this corresponding annular groove between the bushing flange and the end of the collar. Due to this entrapment, the actuator sleeve thus can remain in a fixed linear position relative to the first end 11 and the first connector 21. Put another way, the actuator sleeve 30 does not move linearly, and remains linearly stationary along the longitudinal axis. The actuator sleeve, however, can still rotate in direction R1 or R2 about the longitudinal axis. As it does, the flange 37F slides and moves relative to the bushing flange 27F and the end 25E of the collar 23.

A method of using the support pod 10 and base 20 to orient a weapon will now be described. As mentioned above, the support pod 10 optionally can be in the form of a bipod that supports a weapon 100 in a firing position, for example as shown in FIG. 1. In general, a user can adjust the length LL of the bipod leg or support pod 91 to generally set the elevation of the barrel of the weapon to fire at a target. After that length LL is set, the user can use the base 10 to fine tune the final overall length OL of the support pod plus base. The base 10 can be adjusted in its length, for example, as shown in FIG. 1 from a first base length BL1 to a second base length BL2, which as shown is greater than base length BL1, but of course the adjustment could be reversed, going from a greater length to a shorter length.

The method of adjusting the length of the base 10 can include releasably engaging the support pod 91, for example its lower end 95 with the first connector 21; rotating the actuator sleeve 30 relative to the core post 40 to extend and/or retract the core post along the longitudinal axis LA, to thereby adjust a length of the base for example from BL1 to BL2, or vice versa or some other length in between.

The method optionally can include moving the locking ring 60 along the core post 40 to selectively engage, which can include engaging or disengaging, the actuator sleeve 30. This in turn can prevent or allow the actuator sleeve from rotating. When the locking ring is engaged with the actuator sleeve, this can set the length of the base at a fixed length, optionally in a locked mode. The base 10 can be transitioned from the locked mode to an adjustment mode and back to a locked mode. The base 10 can initially can be in a locked mode shown in FIG. 3, where the locking ring 60 can engage the actuator sleeve 30. Due to the interaction of the locking ring with the actuator sleeve, the actuator sleeve 30 is immovable and non-rotatable, so the core post likewise cannot be extended or retracted relative to the first connector or other components. As shown in FIG. 4, the locking ring can be moved away from the actuator sleeve so that the base is in an adjustment mode. The actuator sleeve 30 can be rotated, so the core post 40 can move and thus extend or retract relative to the first connector or the other components, depending on the desired length adjustment. Optionally, the rotational movement of the actuator sleeve can translate to linear movement of the core post to adjust the length of the base.

With reference to FIGS. 3-5, the actuator sleeve 30 can be rotated in direction R1 after the locking ring 60 is converted to an adjustment mode. Upon this rotation, the threads of the actuator sleeve 30 engage the threaded portion 41 of the core post. As result, the core post moves in direction E to extend away from the first end 11 and the first connector 21. As this occurs, the shaft slot 42S slides relative to the pin 50. Movement of the pin within the slot 42S can be limited by the ends 42S1 and 42S2 of the slot. These ends can set the minimum and maximum extension and retraction of the core post 40, along with, in addition to or instead of the actuator sleeve 30 engaging the locking ring or a portion of the core post.

The shaft 42 also can slide and move relative to the bushing 27, washer 26 and out of the bore 230. The core post and the shaft thus move along the longitudinal axis but do not rotate about that axis LA. Accordingly, the length of the base increases from BL1 to BL2. It is noted here that because the core post does not rotate, the footpad 70 also does not rotate. Accordingly, the length of the base can be increased, decreased or otherwise adjusted without rotating the footpad and its ground engagement tip or portion 77 relative to the ground. In turn, this does not burrow the tip or footpad into the ground or otherwise disturb the surface upon which the footpad 70 is placed.

As shown in FIG. 5, after the length of the base 10 is adjusted, the locking ring 60 can be tightened again and engage the lower rim 32 of the actuator sleeve so that the actuator sleeve will not rotate relative to the core post and/or first connector 21 in a locking mode. The process above can be repeated one or more times to set the length of the base to a fixed length.

The method of using the base 10 optionally can include attaching or detaching the foot pad 70 to or from the base. As noted above, the base can include a second connector 22 joined with the core post 40. The connection element 72 can be inserted into the bore 22B of the second connector 22. The detent 22D can interface with the corresponding portion of the detent in the core post 40 to thereby releasably or detachably join the footpad 70 with the base. Of course, to remove the footbed 70 from the base and the second connector 22, the detent 22D can be actuated to remove it therefrom. A variety of different footpads can be configured to fit the second connector 22. A user can switch between a variety of differently configured footpads depending on the ground surface upon which the bipod is to be used.

When the footpad 70 is installed, that footpad can engage the ground surface to support the bipod and thus the weapon to which the bipod is attached. The base can generally be disposed between the end of the support pod 91 and the footpad 70 connecting those elements to another. As mentioned above, the switch from one footpad to another, the second connector can be actuated to release the footpad from the second connector. The other footpad can then be replaced and joined with the second connector 22.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

What is claimed is:

1. A base for a support pod configured to support a weapon in a firing position, the support pod extending from a connector that engages the weapon, the base comprising:

a first end including a first connector that is configured to releasably engage a support pod lower end distal from a pod connector of the support pod that engages a weapon, the first connector being actuatable to release the first connector from the support pod lower end upon actuation by a user;

a second end distal from the first end;

a longitudinal axis extending between the first end and the second end;

a core post disposed between the first end and the second end, the core post having a threaded portion and a shaft extending from the threaded portion;

an actuator sleeve rotatably mounted around the core post on the threaded portion, the actuator sleeve rotatable to at least one of extend and retract the core post relative to at least one of the first end and the second end, and thereby adjust a length of the base; and a locking ring threaded on the threaded portion, the locking ring rotatable to move along the threaded portion, the locking ring configured to selectively engage the actuator sleeve and prevent the actuator sleeve from rotating such that the core post can no longer at least one of extend and retract, to thereby set the length of the base at a fixed length.

2. The base of claim 1 comprising:

a second connector joined with the second end, the second connector configured to releasably engage a footpad, the second connector being actuatable to release the footpad from the second end upon actuation by a user.

3. The base of claim 2, wherein the first connector includes a ball detent, wherein the second connector includes another ball detent.

4. The base of claim 1, wherein the a shaft defines a slot, wherein a pin projects through the shaft to prevent relative rotational movement of the core post relative to the first end, wherein the core post remains linearly moveable toward and away from the first end.

5. The base of claim 4, wherein the first end includes a bore, wherein the shaft is moveable into and out from the bore when the core post at least one of extends and retracts.

6. The base of claim 1, comprising:

a bushing that is fixedly joined with the first end, wherein the bushing includes a first flange, wherein the actuator sleeve includes a second flange that is rotatable relative to the first flange, wherein the first flange prevents the actuator sleeve from linearly moving relative to the first end.

7. The base of claim 1, wherein the first end includes a collar, wherein the collar includes the first connector, wherein the collar includes a limiter ring adjacent the actuator sleeve so that the actuator sleeve cannot ride up the collar.

8. The base of claim 7, wherein the collar includes a shoulder, wherein the actuator sleeve includes a rim, wherein the rim is configured to abut and rotate relative to the shoulder.

9. The base of claim 8 comprising:

a pin extending through a hole defined by the collar and a slot defined by the shaft.

10. The base of claim 1, comprising:

a pin registered in and slidable relative to a slot defined by the shaft, the pin being fixedly joined with the first end so that the core post can be extended and retracted relative to but cannot be disassociated from the first end.

11. The base of claim 1, comprising:

a footpad removably secured to the second end of the base, the footpad configured to engage a ground surface.

12. A base for a support pod configured to support a weapon in a firing position, the support pod extending from a connector that engages the weapon, the base comprising:

a first connector that is configured to releasably engage a support pod lower end distal from a pod connector of the support pod that engages a weapon, the first connector being actuatable to release the first connector from the support pod lower end upon actuation by a user;

a core post joined with the first connector, the core post having a threaded portion and a shaft extending from the threaded portion;

an actuator sleeve threadably and rotatably engaged with the core post to at least one of extend and retract the core post along a longitudinal axis, and thereby adjust a length of the base, wherein the actuator sleeve remains linearly stationary along the longitudinal axis when rotated to at least one of extend and retract the core post.

13. The base of claim 12 comprising:

a locking ring rotatable to move along the threaded portion, the locking ring configured to selectively engage the actuator sleeve and prevent the actuator sleeve from rotating, to thereby set the length of the base at a fixed length.

14. The base of claim 13 comprising:

a second connector joined with the core post, the second connector configured to releasably engage a footpad, the second connector being actuatable to release the footpad from the second end upon actuation by a user, wherein the actuator sleeve is rotatable to adjust the length of the base without the footpad rotating relative to a ground surface while the footpad engages the ground surface.

15. The base of claim 12 comprising:

a collar including the first connector and a shoulder, a limiter ring adjacent the actuator sleeve so that the actuator sleeve cannot ride up the collar wherein the actuator sleeve includes a rim, wherein the rim is configured to abut and rotate relative to the shoulder.

16. The base of claim 12 comprising:

a collar including the first connector; and a pin extending through a hole defined by the collar and a slot defined by the shaft.

17. The base of claim 16, wherein the pin is slidably disposed in the slot so that the shaft can move linearly along the longitudinal axis so the length can be adjusted, wherein the pin rotationally fixes the core post relative to the collar, wherein as the actuator sleeve rotates relative to the collar and the core post, the pin slides in the slot.

18. A method of adjusting a length of a base for a support pod configured to support a weapon in a firing position, the support pod extending from a connector that engages the weapon, the method comprising:

releasably engaging, with a first connector, a support pod lower end distal from a pod connector of the support pod that engages a weapon, the first connector being actuatable to release the first connector from the support pod lower end upon actuation by a user, the first connector being joined with a core post having a threaded portion and a shaft extending from the threaded portion;

rotating an actuator sleeve relative to the core post to at least one of extend and retract the core post along a longitudinal axis, and thereby adjust a length of the base; and moving a locking ring along the core post to selectively engage the actuator sleeve and prevent the actuator sleeve from rotating, to thereby set the length of the base at a fixed length.

19. The method of claim 18 comprising:

providing a second connector joined with the core post;

releasably engaging a footpad with the second connector;

engaging the footpad with a ground surface to support the weapon, wherein the base is disposed between the end of the support pod and the footpad, wherein the second connector is actuatable to release the footpad from the second end, wherein the actuator sleeve is rotatable to adjust the length of the base without the footpad rotating relative to the ground surface.

20. The method of claim 18 comprising:

translating rotational movement of the actuator sleeve to linear movement of the core post to adjust the length of the base.

* * * * *